US005815777A

United States Patent [19]

Hirabayashi

[11] Patent Number: 5,815,777

[45] Date of Patent: Sep. 29, 1998

[54] IMAGE FORMING APPARATUS

[75] Inventor: Jun Hirabayashi, Numazu, Japan

[73] Assignee: Canon Kabushiki Kaisha, Tokyo, Japan

[21] Appl. No.: 870,725

[22] Filed: Jun. 6, 1997

[30] Foreign Application Priority Data

Jun. 7, 1996 [JP] Japan ..... 8-146139

[51] Int. Cl.[6] ..... G03G 15/02

[52] U.S. Cl. ..... 399/174; 399/159; 399/175; 399/176

[58] Field of Search ..... 399/174–176, 399/159; 361/225, 230; 430/56, 57, 58, 66, 69, 83

[56] References Cited

U.S. PATENT DOCUMENTS

| | | | |
|---|---|---|---|
| 5,606,401 | 2/1997 | Yano | 399/174 |
| 5,666,192 | 9/1997 | Mashimo et al. | 399/174 |
| 5,708,932 | 1/1998 | Yano et al. | 399/159 |

FOREIGN PATENT DOCUMENTS 6-3921 1/1994 Japan .

*Primary Examiner*—Matthew S. Smith
*Attorney, Agent, or Firm*—Fitzpatrick, Cella, Harper & Scinto

[57] ABSTRACT

An image forming apparatus includes: an image bearing member including a surface layer having a volume resistivity which changes with intensity of the electric field; an image forming device for forming, on the image bearing member, an electrostatic image having a portion of dark potential VD (V) and a portion of light potential VL (V) with a resolution of A (dot/micron) the image forming means including a charging member contactable to the image bearing member to charge the image bearing member by applying a voltage of the charging member; wherein the volume resistivity RDL (Ohm.cm) of the surface layer under the electric field of $|VD-VL|\times A$, if larger than $1.0\times10^{11}$ (Ohm.cm), and is not less than twice as large as RD which is a volume resistivity of the surface layer (Ohm.cm) under the electric field of $VD\times A$, and the volume resistivity RD is smaller than $2.0\times10^{13}$.

5 Claims, 4 Drawing Sheets

| CONDITION | CN | DRUM 1 | DRUM 11 | DRUM 12 | DRUM 13 |
|---|---|---|---|---|---|
| FOG | 5mm | O | X | O | X |
| FLOW | 5mm | O | O | X | O |
| FOG | 7mm | O | X | O | O |
| FLOW | 7mm | O | O | X | O |

FIG. 4

| CONDITION | 1 | 2 | 3 | 4 |
|---|---|---|---|---|
| DARK PORTION POTENTIAL | 650 | 650 | 810 | 980 |
| LIGHT PORTION POTENTIAL | 150 | 150 | 310 | 480 |
| (RESISTANCE DURING IMAGE FORMATION)/(RESISTANCE DURING CHARGING) | 1.8 | 2 | 2.5 | 3 |
| FOG | X | O | O | O |

FIG. 5

IMAGE FORMING APPARATUS

FIELD OF THE INVENTION AND RELATED ART

The present invention relates to an image forming apparatus such as a copy machine, a printer, or the like.

In an image forming apparatus employing an electrophotographic system or an electrostatic recording system, an image forming process such as the following is carried out. First, the surface of an image bearing member, for example, an electrophotographic photosensitive member, an electrostatically recording dielectric member, or the like, is uniformly charged by a charging member. Then, an exposing light reflecting the image data of a target image is projected onto the charged portion of the image bearing member, the remove the charge from the areas exposed to the exposing light. As a result, an electrostatic latent image reflecting the image data of the target image is formed. The electrostatic latent image is developed into a visual image in a developing station. Next, the visible image is transferred onto a sheet of transfer paper in a transferring station, and then is fixed by a fixing device. The residual developer, that is, the developer which fails to be transferred in the transferring station, is removed from the image bearing member by a cleaning member.

In an image forming apparatus based on a conventional electrophotographic system, or a conventional electrostatic recording system, a corona type charging device has been employed as means for charging an image bearing member such as an electrophotographic photosensitive member, an electrostatically recordable dielectric member, or the like. In recent years, a variety of contact type image forming apparatuses have been put to practical use, which employ a system in which an image bearing member (photosensitive member) is charged by placing a charging member, to which voltage is applied, in contact with the photosensitive member. These charging apparatuses are characterized in that they produce a smaller amount of ozone, and consume a smaller amount of electricity, than the image forming apparatuses employing the aforementioned conventional system. Among the image forming apparatuses based on this contact type system, contact type charging apparatuses employing a charging roller, that is, an electrically conductive elastic roller (hereinafter, "electrically conductive roller" or simply "conductive roller"), as a charging member are particularly desirable from the standpoint of stability in charging performance. In the case of a contact type charging apparatus employing a charging roller, a photosensitive member is charged through a process in which a conductive roller is placed in contact with a photosensitive member with a predetermined contact pressure, and voltage is applied to the conductive roller.

However, even in the case of a contact type charging apparatus such as the one described above, the charging mechanism is based on electrical discharge from a charging member to a photosensitive drum, and therefore, the value of the voltage to be applied to a charging member to charge a photosensitive member must be greater than the value of the surface potential level to which the surface of the photosensitive member is to be charged, and a small amount of ozone is produced. Thus, a variety of charging apparatuses employing a newer charging system have been proposed in Japanese government journal Tokkai No. 3,921/1994 and the like. According to this newer system, electrical charge is directly injected into an image bearing member. More specifically, this newer charging system, that is, a direct injection type charging system, is a system in which a photosensitive member is directly charged through a process in which electrical charge is directly injected into the traps present in the surface layer of the photosensitive member, or the charge carrier members such as electrically conductive particles disposed in the surface layer of the photosensitive member, by applying voltage to a contact type charging member, for example, a charging roller, charging brush, a magnetic charging brush, or the like. In the case of this direct injection type charging system, electrical discharge is not a dominant factor; in other words, the value of the voltage necessary to charge a photosensitive member to a predetermined potential level may be substantially the same as the value of the predetermined potential level to which the photosensitive member is to be charged, and also, practically no ozone is produced.

However, an image forming apparatus employing the above described conventional direct injection type charging system has a problem in that the state of contact across the contact nip formed between the surface of a contact type conductive member and the surface of a photosensitive member is not uniform, and therefore, the surface of the photosensitive drum is nonuniformly charged. In other words, the charge obtained by this new system also displays undesirable characteristics.

Further, when the volumetric resistivity of the surface layer of an image bearing member is reduced so that charge can be more efficiently injected into the image bearing member, the surface charge is liable to become unstable, which in turn is liable to trigger a so-called image flow phenomenon in an electrostatic image.

SUMMARY OF THE INVENTION

Accordingly, the primary object of the present invention is to provide an image forming apparatus capable of uniformly charging an image bearing member by a charging member, without triggering a flowing-image phenomenon.

Another object of the present invention is to provide an image forming apparatus which allows electrical charge to easily shift within the surface layer of the image bearing member during a charging period so that the image bearing member is uniformly charged.

Another object of the present invention is to provide an image forming apparatus in which the ease with which electrical charge is allowed to shift within the surface layer of the image bearing member during a charging period is rendered different from that after the formation of an electrostatic image.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 4 is a table which comparatively presents the results of the evaluation of the images formed with the use of the photosensitive member described in the embodiment, and comparative photosensitive members.

FIG. 5 is a table which comparatively presents the results of the evaluation of the images which were formed when the unexposed portion potential and the exposed portion potential in the surface layer of a photosensitive member were varied to study the correlation between the quotient of the resistance value of the surface layer of an image bearing member during image formation to that during the charging of an image bearing member, and the occurrence of the fog.

DESCRIPTION OF THE PREFERRED EMBODIMENTS

Hereinafter, the embodiment of the present invention will be described with reference to the drawings.

Figure 1:
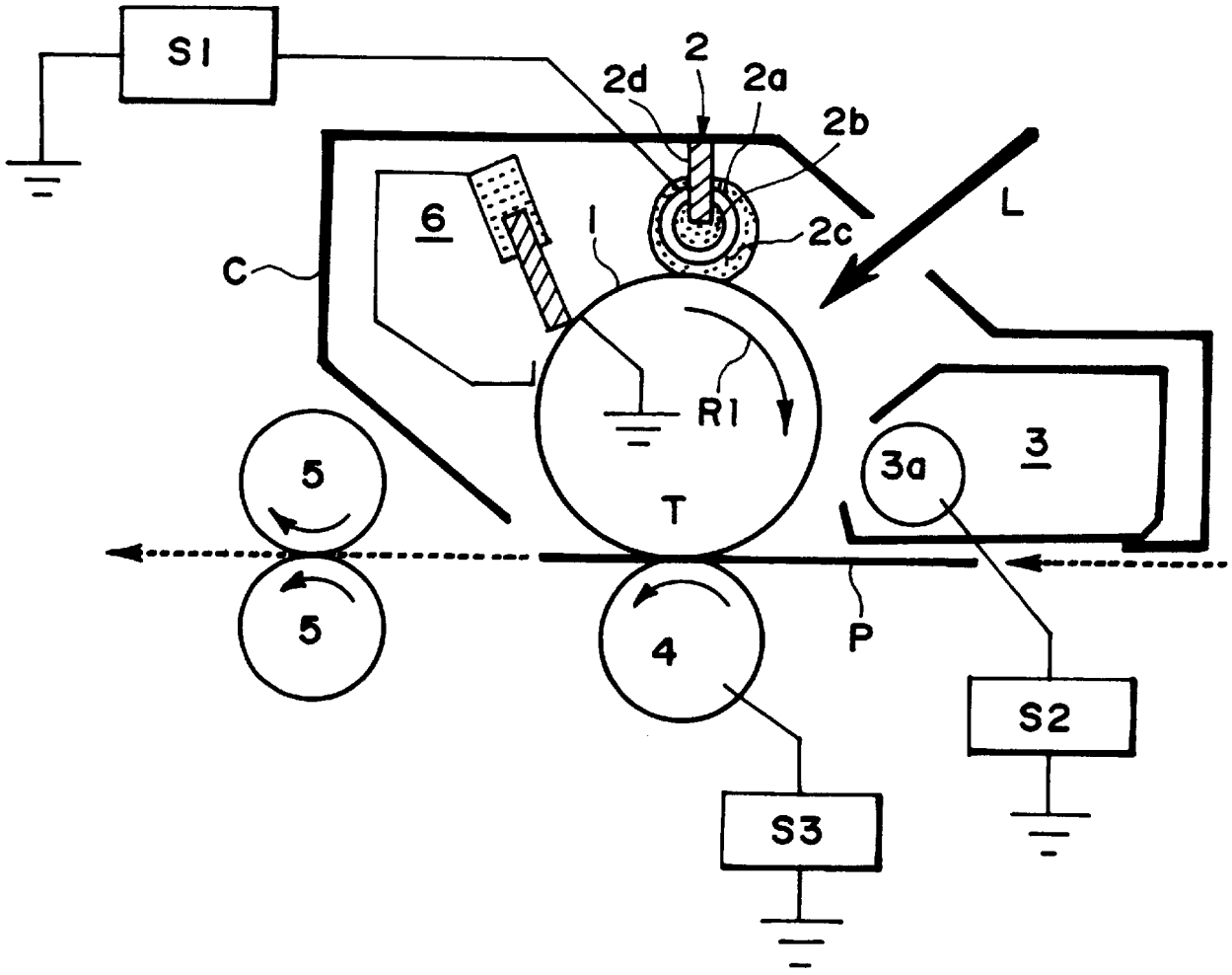
FIG. 1 is a schematic section of the image forming apparatus in the first embodiment of the present invention, depicting the structure thereof.
Figure 2:
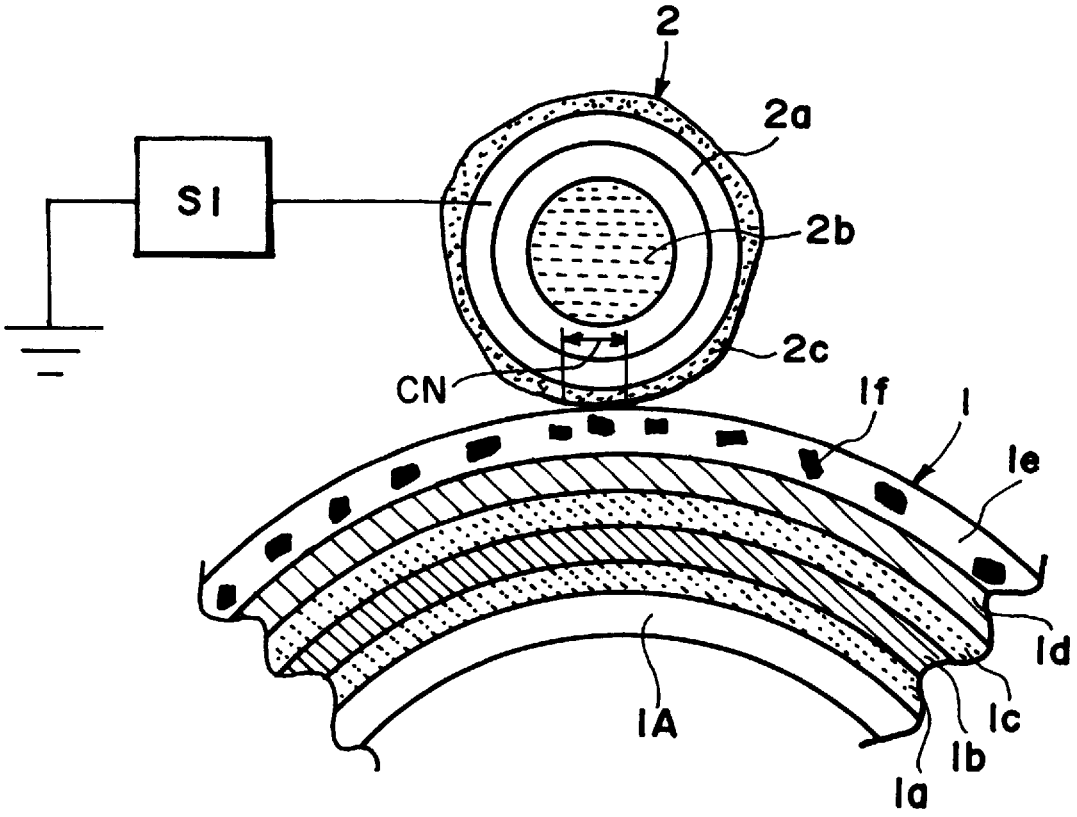
FIG. 2 is an enlarged sectional view of the contact area between the magnetic brush and the photosensitive member in the first embodiment of the present invention.

FIG. 1 is a schematic section of the image forming apparatus in the first embodiment of the present invention. FIG. 2 is an enlarged section of the contact area between the magnetic brush, that is, a charging device, and the photosensitive drum, which are illustrated in FIG. 1. The image forming apparatus illustrated in FIG. 1 is a laser beam printer employing an electrophotographic process. In FIG. 1, a reference numeral 1 designates an electrophotographic photosensitive member (hereinafter, "photosensitive member") as an image forming member. The photosensitive member 1 is in the form of a rotary drum with a diameter of 30 mm, and is rotatively driven in the direction of an arrow mark R1 at a peripheral velocity of 94 mm/sec. It is an OPC type photosensitive member. Around the photosensitive member 1, a magnetic brush type charging device 2 as a contact type charging member, a reversal type developing apparatus 3 which develops an electrostatic latent image formed on the photosensitive member 1, a transferring member (transfer roller) 4 as a contact type transferring member placed in contact with the photosensitive member 1 with a predetermined contact pressure, and a cleaning apparatus 6 which cleans the toner which remains on the photosensitive member 1 after a visible image formed on the photosensitive member 1 is transferred onto a transfer sheet P as recording medium, are disposed in this order relative to the rotational direction of the photosensitive member 1. Further, the image forming apparatus in this embodiment is structured to employ a cartridge C which integrally contains the photosensitive drum 1, magnetic brush type charging device 2, reversal type developing apparatus 3, and cleaning apparatus 6, and is removably installed in the main assembly of the image forming apparatus. Generally, a process cartridge contains a photosensitive member, and a least one processing apparatus among a magnetic type charging device, a developing apparatus, and a cleaning apparatus. The transfer sheet P on which a visible image has been transferred is separated from the photosensitive member 1, and then, the visible image is fixed to the transfer sheet P by the fixing apparatus 5 which uses heat for fixation.

Figure 3:
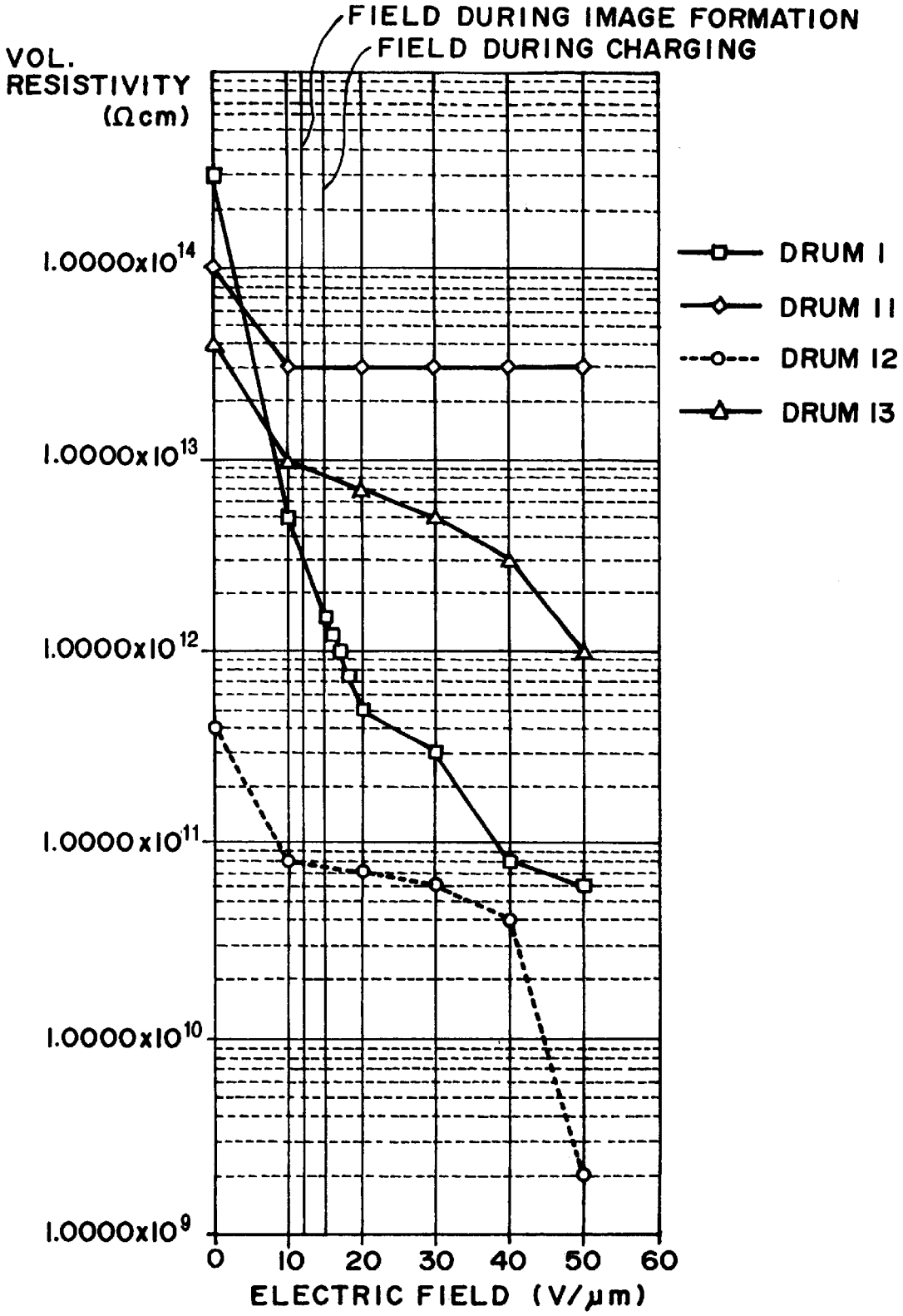
FIG. 3 is a graph showing the relationship between the resistance value of the surface layer of the photosensitive member and the electrical field strength, in the first embodiment of the present invention.

Referring to FIG. 2, the photosensitive drum 1 comprises a grounded base member 1A constituted of an aluminum drum, and first to fifth functional layers laminated on the base member 1A in this order from the bottom. The first layer 1*a* is an approximately 20 $\mu$m thick undercoat layer, which is placed to smooth out the defects of the base member 1A, and prevent the occurrence of moire effected by the reflection of a laser beam L. The second layer 1*b* is a static charge injection prevention layer, which prevents the negative charge given to the surface of the photosensitive member 1 from being canceled by the positive charged injection from the base member 1A side. It is an approximately 1 $\mu$m thick layer composed of Amilan resin and methoxymethyl nylon, and has a medium resistance of approximately $1\times10^6$ Ω.cm. The third layer 1*c* is an approximately 0.3 $\mu$m thick charge generating layer formed of resin material in which diazo pigment is dispersed, and generates a positive-negative charge couple as it is exposed to the laser beam L. The fourth layer 1*d* is a charge transfer layer formed of polycarbonate resin which dispersively contains hydrazine. In other words, it is a layer of P-type semiconductor, and therefore, the negative charge given to the surface of the photosensitive member 1 cannot transfer through this charge transfer layer 1*d,* but the positive charge generated in the charge generation layer 1*c* can transfer to the surface layer of the photosensitive member 1. The fifth layer 1*e* is an approximately 3 $\mu$m thick charge injection layer, a coated layer formed of polycarbonate resin which dispersively contains microscopic particles 1*f* of SiC. The resistance of the fifth layer 1*e,* the charge injection layer, is adjusted by changing the amount of SiC dispersed in the polycarbonate resin. The thickness of the fifth layer 1*e* is desirably no more than 10% of the combined thickness of the first to fifth layers. FIG. 3 shows the relationship between the resistance value $R_{DL}$ of the fifth layer of the photosensitive member and the strength of the electric field, for four different photosensitive members: the photosensitive member 1 in this embodiment; comparative photosensitive members 11 and 12, the fifth layers of which are formed of polycarbonate resin which dispersively contains hydrazine; and a comparative photosensitive member 13 whose charge injection layer is modified in the amount of SiC dispersed therein. The resistance values in this table are those of the fifth layer samples coated on aluminum sheet. They were measured with the use of High Resistance Meter 4329A (Yokogawa-Hewlette-Packard) connected to Resistivity Cell 16008A while applying a voltage of 100 V.

Also referring to FIG. 2, the magnetic type charging device 2 is disposed in contact with the photosensitive member 1. It comprises an electrically conductive nonmagnetic rotary sleeve 2*a* with a diameter of 16 mm, a 230 mm long magnet roller 2*b* enclosed in the conductive sleeve 2*a,* and electrically conductive magnetic particles 2*c* held on the peripheral surface of the conductive sleeve 2*a* by the magnetic force of the magnet roller 2*b*. The magnet roller 2*b* is fixed to a supporting member 2*d* (FIG. 1), being oriented so the magnetic poles are pointed in the predetermined directions. The conductive sleeve 2*a* is rotatively driven in such a direction that its rotational direction at the contact area between the photosensitive member 1 and the magnetic brush 2*a* becomes opposite to the rotational direction of the photosensitive member 1. To the conductive sleeve 2*a,* a charge bias power source S1 is connected, constituting charging means. To the peripheral surface of the photosensitive member 1, a charge bias voltage of −680 V is applied by the charge bias power source S1, whereby the surface is uniformly charged to approximately −650 V. The gap between the photosensitive member 1 and the conductive sleeve 2*a* is 500 $\mu$m wide when neither is in motion, and is filled with a magnetic brush formed of the electrically conductive magnetic particles 2*c*. The dimension of the magnetic brush in the circumferential direction of the photosensitive drum 1 can be changed by changing the amount of the conductive magnetic particles 2*c*. Although the magnetic brush 2 is employed as the contact type charging member in this embodiment, the present invention is not limited by this embodiment; for example, a fur brush (brush of fibrous material), a charge roller, or the like may be employed. The volumetric resistivity of the magnetic particles 2*c* is desirably in a range of $1\times10^4$ Ω.cm–$1\times10^7$ Ω.cm. The volumetric resistivity values given in FIG. 3 were measured using an aluminum drum in place of the photosensitive member 1, while applying a voltage of 100 V to the conductive sleeve 2*a* in an environment in which temperature and humidity were 23° C. and 65%, respectively.

The charged surface of the photosensitive drum 1 is exposed to a laser beam L emitted from an unillustrated laser beam scanner comprising a laser diode, polygon mirror, and the like. With the intensity of the laser beam L being modulated in response to sequential electrical digital signals reflecting the image data, an electrostatic latent image correspondent to the image data is formed on the charged surface of the photosensitive member 1. A potential $V_L$ of the exposed surface areas (light portion) of the photosensitive member 1 becomes approximately 150 V. The potential $V_L$ is such a potential that corresponds to the maximum quantity of light carried by the laser beam L, provided that the quantity of light carried by the laser beam L is variable.

The reversal type developing apparatus 3 develops an electrostatic latent image formed on the photosensitive member 1, into a visible image with the use of negatively chargeable, magnetic, electrically insulative, single component developer (toner). It comprises a nonmagnetic developing sleeve 3*a* with a diameter of 16 mm. The nonmagnetic developing sleeve 3*a* contains a magnet, and the aforementioned toner is coated on this nonmagnetic developing sleeve 3*a*. It is positioned so the distance between the surface thereof and the surface of the photosensitive member 1 becomes 300 μm, and is rotated at the same peripheral velocity as the photosensitive member 1. As development bias voltage composed by superposing an AC voltage having a frequency of 1,800 Hz, a peak-to-peak voltage of 1,600 V and a rectangular wave-form, onto a DC voltage of −500 V, is applied to the nonmagnetic developing sleeve 3*a* by a development bias power source S2, the electrostatic latent image on the photosensitive member 1 is developed through jumping development which occurs between the nonmagnetic developing sleeve 3*a* and the photosensitive member 1.

To a transfer roller 4, a predetermined transfer bias voltage is applied from a transfer bias application power source S3. In this embodiment, the resistance value of the transfer roller 4 is $5\times10^8$ Ω, and the voltage applied for transfer is a DC voltage of +2,000 V.

On the other hand, the transfer sheet P is fed from an unillustrated sheet feeding section, and is introduced into a compressive contact portion (transfer station) T between the photosensitive member 1 and the transfer roller 4 with medium electrical resistance, with a predetermined timing, and then, is passed through the transfer station T, being pinched by the photosensitive member 1 and the transfer roller 4. While the transfer sheet P is passed through the transfer station T, the visible image carried on the peripheral surface of the photosensitive member 1 is transferred onto the surface of the transfer sheet P, from the leading end to the trailing end, by the electrostatic force and the pressure. Thereafter, the surface of the photosensitive member 1 is cleaned by the cleaning apparatus 6 to remove the residual toner.

After receiving the visible image, the transfer sheet P is separated from the peripheral surface of the photosensitive member 1, and is introduced into the fixing apparatus 5 employing a thermal fixing system or the like, in which the visible image is fixed to the transfer sheet P, and then, it is discharged as a print or a copy from the image forming apparatus.

The resolution A (image resolving power) of the image forming apparatus in this embodiment is 600 dots per inch.

The image forming apparatus in this embodiment is a cartridge based apparatus whose main assembly is structured to accommodate a removably installable cartridge comprising a cartridge shell C, and four processing means: the photosensitive member 1, contact type charging member 2, developing apparatus, and cleaning apparatus 6, which are integrally disposed within the cartridge shell C. The present invention is not limited to this embodiment.

FIG. 4 presents the results of the evaluation of the images formed by the image forming apparatus in this embodiment, and the image forming apparatuses comprising comparative photosensitive members 11, 12 or 13. An alphabetic reference CN in FIG. 4 designates the length of the contact area between the contact type charging member 2 and the photosensitive member 1 in the circumferential direction of the photosensitive member 1.

In this embodiment, a potential $V_D$ of an unexposed portion (dark portion) is −650 V, and a potential $V_L$ of the exposed portion (light portion) is −150 V. Since the resolution A is 600 dots per inch, the distance between the adjacent two picture elements is 1 (inch)/600 (dots)=$2.54\times10^4$ (μm) /600 (dots).

Then, the strength of the electric field between the adjacent two picture elements is obtained from the following mathematical formula (1):

$$|V_D(\text{Volts})-V_L(\text{Volts})|/(2.54\times10^4\ (\mu\text{m})/600\ \text{dots}))\ (\text{Volts}/\mu\text{m}) \quad (1)$$

Therefore, the strength of the electric field between the edges of the dark and light portions during an image forming period is obtained from the following mathematical formula (2):

$$|V_D(\text{Volts}) - V_L(\text{Volts})| \times \text{resolution } A(\text{dots}/\mu\text{m}) = (650 - 150)(\text{Volts}) \times 0.024\ (\text{dots}/\mu\text{m}) = 12\ (\text{Volts}/\mu\text{m}) \quad (2)$$

Similarly, during a charging operation, the strength of the electric field between a contact point, and a noncontact point immediately adjacent to the contact point is obtained from the following mathematic formula (3), wherein the potential at the contact point is $V_D$ (V), and the potential at the noncontact point is 0 (V):

$$V_D(\text{Volts}) \times \text{resolution } A(\text{dots}/\mu\text{m}) = 650\ (\text{Volts}) \times 0.024\ (\text{dots}/\mu\text{m}) = 15\ (\text{Volts}/\mu\text{m}) \quad (3)$$

When the photosensitive member 11 is employed, the resistance value $R_{DL}$ of the surface layer in the electric field between the edges of the dark and light portions during an image forming period becomes greater than $1.0\times10^{11}$ Ω.cm, and therefore, the image flow does not occur. However, the resistance value $R_D$ of the surface layer in the electric field adjacent to the contact point during a charging period becomes greater than $2.0\times10^{13}$ Ω.cm, and therefore, the charge characteristics become inferior, resulting in the fog traceable to nonuniform charging of the photosensitive member.

When the photosensitive member 12 is employed, the resistance value $R_D$ of the surface layer in the electric field adjacent to the contact point during a charging period becomes smaller than $2.0\times10^{13}$ Ω.cm, and therefore, the nonuniform charging of the photosensitive member 1 does not occur. However, the surface layer resistance value $R_{DL}$ in the electric field between the edges of the dark and light portions during an image forming period becomes smaller than $1.0\times10^{11}$ Ω.cm, and therefore, the image flow occurs.

When the photosensitive member 13 is employed, the resistance value $R_D$ of the surface layer in the electric field adjacent to the contact point during a charging period becomes smaller than $2.0\times10^{13}$ Ω.cm, and therefore, the charge characteristics become desirable provided that the contact area size is large (dimension CN of the contact area in the circumferential direction of the photosensitive drum 1 in FIG. 4 is 7 mm). Further, the surface layer resistance value $R_{DL}$ in the electric field between the edges of the dark and light portions during an image forming period becomes large than $1.0\times10^{11}$ Ω.cm, and therefore, the image becomes desirable in terms of the flowing-image phenomenon. However, when the contact area size is smaller (dimension CN of the contact area in the circumferential direction of the photosensitive drum 1 in FIG. 4 is 5 mm), the fog traceable to the nonuniform charging of the photosensitive drum 1 occurs. It is conceivable that this is due to the possibility that the surface layer resistance value in the electric field adjacent to the contact point during a charging period is still relatively large.

In comparison, when the photosensitive member 1 is employed, the resistance value $R_D$ of the surface layer in the electric field adjacent to the contact point during a charging period becomes smaller than $2.0\times10^{13}$ Ω.cm, and therefore, the charge characteristics become desirable, the fog being prevented. Further, the surface layer resistance value $R_{DL}$ in the electric field between the edges of the dark and light portions during an image forming period becomes larger than $1.0\times10^{11}$ Ω.cm, and therefore, the image flow does not occur. In addition, even when the contact area becomes smaller, the image becomes desirable in terms of both the fog and the image flow.

Next, for the purpose of investigating the correlation between the surface layer resistance value during an image forming period/surface layer resistance value during a charging period, and the fog, the images created by the photosensitive drum 1 while varying the unexposed portion potential $V_D$ and the exposed portion potential $V_L$ were evaluated. The unexposed portion potential $V_D$ and the exposed portion potential $V_L$ were varied by varying the potential level to which the surface layer was charged, and the amount of exposure to the laser beam. The results of the evaluation are given in FIG. 5.

The results given in FIG. 5 reveal that when the surface layer resistance value during an image forming period is twice or more the surface layer resistance value during a charging period, the fog traceable to the deterioration of the charge characteristics can be effectively prevented. It should be noted here that the results under Condition 1 in FIG. 5 were obtained using the photosensitive member 13.

Based on the above observations, the inventors reached the following conclusion regarding the resistance value of the surface layer of an image bearing member.

When the resistance value of the surface layer of an image bearing member is greater than $1.0\times10^{11}$ Ω.cm in the electric field, the strength of which is expressed by the mathematical formula:

$$|V_D(\text{Volts})-V_L(\text{Volts})|\times\text{resolution A (dots/}\mu\text{m) (Volts/}\mu\text{m)}$$

the image flow does not occur. Further, when the following conditions are satisfied, in addition to the preceding condition, that is, when the surface layer resistance value is twice or more the surface layer resistance value in the electric field, the strength of which is expressed by the mathematical formula:

$$V_D\text{ (Volts)}\times\text{resolution A (dots/}\mu\text{m) (Volts/}\mu\text{m)}$$

and at the same time, the surface layer resistance value in the electric field, the strength of which is expressed by the mathematical formula:

$$V_D\text{ (Volts)}\times\text{resolution A (dots/}\mu\text{m) (Volts/}\mu\text{m)}$$

is smaller than $2.0\times10^{13}$ Ω.cm, the nonuniform charging of the photosensitive member 1 does not occur; the charge characteristics are improved.

As described above, in this embodiment, the charge characteristics are improved, when the resistance value of the surface layer of an image bearing member is greater than $1.0\times10^{11}$ Ω.cm in the electric field, the strength of which is expressed by the following mathematical formula:

$$|V_D(\text{Volts})-V_L(\text{Volts})|\times\text{resolution A (dots/}\mu\text{m) (Volts/}\mu\text{m);}$$

is twice or more the surface layer resistance value in the electric field, the strength of which is expressed by the mathematical formula:

$$V_D\text{ (Volts)}\times\text{resolution A (dots/}\mu\text{m) (Volts/}\mu\text{m); and}$$

is smaller than $2.0\times10^{13}$ Ω.cm in the electric field, the strength of which is expressed by the mathematical formula:

$$V_D\text{ (Volts)}\times\text{resolution A (dots/}\mu\text{m) (Volts/}\mu\text{m)}$$

It is desirable that the surface layer resistance value of an image bearing member becomes smaller as the strength of the electric field becomes stronger.

This is for the following reasons. It is rather difficult for a contact type charging member to come thoroughly in contact with the surface of an image bearing member, and therefore, some areas of the surface of the image bearing member fail to be injected with electrical charge, causing the charge characteristics to be poor. However, when the aforementioned surface layer resistance value of the image bearing member is small, the electrical charge shifts through the surface layer during the charging of the image bearing member, and therefore, the surface layer of the image bearing member can be uniformly charged.

However, when the surface layer resistance value is small, as described above, electrical charge shifts after the formation of an electrostatic latent image, and therefore, the image flow occurs in the electrostatic latent image.

Provided that the distance between the adjacent two points on the surface of the image bearing member, having the unexposed portion potential $V_D$ and the exposed portion potential $V_L$, respectively, is approximately the same as the distance between the adjacent two dots, the electric field strength in the surface layer of the image bearing member with respect to the direction parallel to the surface layer, after image formation, is expressed by the following mathematical formula:

$$|V_D-V_L|\times\text{resolution A (dots/}\mu\text{m) (Volts/}\mu\text{m)}$$

On the other hand, provided that a point of the surface area of the photosensitive member made contact with the contact type charging member, and therefore, has the unexposed portion potential $V_D$(Volts) (potential after charging), whereas another point of the surface area of the photosensitive member did not make contact with the contact type charging member, and therefore, has zero potential (potential before charging), and that these two points are adjacent to each other, the electric field strength in the surface layer of the image bearing member with respect to the direction parallel to the surface layer, during the charging of the image bearing member, is expressed by the following mathematical formula:

$V_D \times$resolution A (dots/$\mu$m) (Volts/$\mu$m)

When the surface layer resistance value of the image bearing member within this electric field is no greater than $2.0\times10^{13}$ Ω.cm, it is easier for electrical charge to shift between the contact point having the potential $V_D$(V), and the noncontact point having 0 V, and therefore, the image bearing member can be uniformly charged.

As is evident from the foregoing, according to the present invention, the electric field strength during the charging of an image bearing member is rendered different from that after the image formation; the electric field strength is rendered greater during the charging of an image bearing member than after the image formation. Thus, providing an image bearing member with a surface layer, the resistance value of which decreases as electric field strength increases, renders the shifting of electrical charge during the charging of an image bearing member different from that after the image formation, and therefore, the charge characteristics can be improved while preventing the occurrence of the image flow.

In the preceding embodiment, a magnetic brush capable of making relatively precise contact with an image bearing member when charging the image bearing member was employed as a contact type charging member. However, the choice of the contact type charging member does not need to be limited to the magnetic brush. According to the present invention, an image bearing member can be uniformly charged even when an inexpensive fur brush or an electrically conductive blade is employed as the contact type charging member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member including a surface layer having a volume resistivity which changes with intensity of an electric field;

image forming means for forming, on said image bearing member, an electrostatic image comprising a portion of dark potential VD (V) and a portion of light potential VL (V) with a resolution of A (dot/micron) said image forming means including a charging member contactable to said image bearing member to charge said image bearing member by applying a voltage to said charging member;

wherein the volume resistivity RDL (Ohm.cm) of the surface layer under the electric field of $|VD-VL|\times A$, is larger than $1.0\times10^{11}$ (Ohm.cm), and is not less than twice as large as RD which is a volume resistivity of the surface layer (Ohm.cm) under the electric field of $VD\times A$, and the volume resistivity RD is smaller than $2.0\times10^{13}$.

2. An apparatus according to claim 1, wherein said surface layer comprises polycarbonate resin material and SiC particles dispersed therein.

3. An apparatus according to claim 1, wherein said charging member includes a magnetic brush.

4. An apparatus according to claim 1, wherein said charging member includes a fibrous brush.

5. An apparatus according to claim 1, wherein said image bearing member includes a photosensitive layer inside said surface layer.

* * * * *

UNITED STATES PATENT AND TRADEMARK OFFICE

CERTIFICATE OF CORRECTION

PATENT NO. : 5,815,777

DATED : September 29, 1998

INVENTOR(S) : JUN HIRABAYASHI

It is certified that error appears in the above-identified patent and that said Letters Patent is hereby corrected as shown below:

[57] ABSTRACT

Line 7, "(dot/micron)" should read --(dot/micron),--; and "means" should read --device--.

COLUMN 2

Line 18, "above described" should read --above-described--.

COLUMN 4

Line 1, "charged" should read --charge--.
Line 2, "injection" should read --injected--.
Line 36, "Hewlette-Packard)" should read --(Hewlett-Packard)--.

COLUMN 6

Line 39, "point," should read --point--.
Line 41, "mathematic" should read --mathematical--.

UNITED STATES PATENT AND TRADEMARK OFFICE

CERTIFICATE OF CORRECTION

PATENT NO. : 5,815,777

DATED : September 29, 1998

INVENTOR(S) : JUN HIRABAYASHI

It is certified that error appears in the above-identified patent and that said Letters Patent is hereby corrected as shown below:

COLUMN 10

Line 6, "field;" should read --field; and--.
Line 10, "(dot/micron)" should read --(dot/micron),--.

Signed and Sealed this

Twenty-sixth Day of October, 1999

*Attest:*

Q. TODD DICKINSON

*Attesting Officer*

*Acting Commissioner of Patents and Trademarks*